US007151904B2

(12) United States Patent
Narita et al.

(10) Patent No.: US 7,151,904 B2
(45) Date of Patent: Dec. 19, 2006

(54) CONDUCTIVE MEMBER AND PROCESS CARTRIDGE AND IMAGE FORMING APPARATUS USING THE SAME

(75) Inventors: Yutaka Narita, Tokyo (JP); Makoto Nakamura, Tokyo (JP); Taisuke Tokuwaki, Tokyo (JP); Akiko Tanaka, Tokyo (JP); Tadayuki Ohshima, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/931,116

(22) Filed: Sep. 1, 2004

(65) Prior Publication Data

US 2005/0100365 A1 May 12, 2005

(30) Foreign Application Priority Data

Sep. 18, 2003 (JP) ..... 2003-325716

(51) Int. Cl.
*G03G 15/02* (2006.01)

(52) U.S. Cl. ..... 399/159; 399/168; 399/176

(58) Field of Classification Search ..... 399/159, 399/168, 174, 176
See application file for complete search history.

(56) References Cited

U.S. PATENT DOCUMENTS

| | | | | |
|---|---|---|---|---|
| 5,970,294 | A | 10/1999 | Narita et al. | |
| 5,991,585 | A | 11/1999 | Nakamura | |
| 6,070,038 | A | 5/2000 | Imamura et al. | |
| 6,112,042 | A | 8/2000 | Imamura et al. | |
| 6,287,246 | B1 | 9/2001 | Yoshii et al. | |
| 6,473,588 | B1 | 10/2002 | Nakamura | |
| 6,546,219 | B1 * | 4/2003 | Sato et al. | 399/176 |
| 6,567,638 | B1 | 5/2003 | Nakamura et al. | |
| 6,596,383 | B1 | 7/2003 | Matsuo et al. | |
| 6,641,760 | B1 | 11/2003 | Matsuo et al. | |
| 2002/0001478 | A1 * | 1/2002 | Sugiura | 399/50 |
| 2002/0037180 | A1 * | 3/2002 | Amemiya et al. | 399/176 |
| 2002/0051654 | A1 * | 5/2002 | Niimi et al. | 399/159 |
| 2003/0118372 | A1 * | 6/2003 | Kitano et al. | 399/176 |
| 2003/0138718 | A1 * | 7/2003 | Yagi et al. | 430/125 |

FOREIGN PATENT DOCUMENTS

| | | |
|---|---|---|
| JP | 63-149668 | 6/1988 |
| JP | 1-211779 | 8/1989 |
| JP | 1-267667 | 10/1989 |
| JP | 3-240076 | 10/1991 |
| JP | 4-358175 | 12/1992 |
| JP | 5-107871 | 4/1993 |

OTHER PUBLICATIONS

U.S. Appl. No. 11/340,533, filed Jan. 27, 2006, Narita et al.

* cited by examiner

*Primary Examiner*—William J. Royer
(74) *Attorney, Agent, or Firm*—Oblon, Spivak, McClelland, Maier & Neustadt, P.C.

(57) ABSTRACT

A conductive member includes a conductive supporting body, an electric resistance adjusting layer disposed on a surface of the conductive supporting body, and a space adjusting mechanism including a material different from the electric resistance adjusting layer, which is disposed on the surface of the conductive supporting body and is firmly fixed to an end portion of the electric resistance adjusting layer, wherein the space adjusting mechanism is provided to form a space between an outer surface of the electric resistance adjusting layer and an outer surface of a photoconductor.

9 Claims, 8 Drawing Sheets

CONDUCTIVE MEMBER AND PROCESS CARTRIDGE AND IMAGE FORMING APPARATUS USING THE SAME

FIELD OF THE INVENTION

The present invention relates to a conductive member having an electric resistance adjusting layer arranged on a circumference surface of a conductive supporting body and a pair of space holding members to be firmly fixed to the end face of the electric resistance adjusting layer, which has a material different from the electric resistance adjusting layer and is arranged on the circumference surface of the conductive supporting body. The present invention also relates to a process cartridge and an image forming apparatus using the conductive member.

RELATED ART STATEMENT

Conventionally, an image forming apparatus of electric-photographic type such as a copying machine, laser beam printer, and facsimile is provided with an electrification member for performing an electrification process with respect to a photoconductor drum (image carrier) and a conductive member as a transcription member for carrying out a transcription process with respect to the toner on the photoconductor drum.

FIG. 1 illustrates an example using a conductive member as an electrification member. An electrification roller 2 of an image forming apparatus 1 is used as the electrification member. The image forming apparatus 1 comprises a photoconductor drum 4 on which an electrostatic latent image is formed, an electrification roller 2 for carrying out an electrification process with respect to the photoconductor drum 4, a power pack (power source for applying voltage) 3 for applying voltage to the electrification roller 2, a surface electrometer 5 for measuring surface potential of the photoconductor drum 4, a development roller 6 for transferring toner on the electrostatic latent image of the photoconductor drum 4, a transcription roller 7 for transferring the toner image on the photoconductive drum 4 to a recording paper S, and a cleaning device 8 for cleaning the photoconductor drum 4 after being transferred. As shown in FIG. 2, a process cartridge 9 which contains the photoconductor drum 4, the electrification roller 2, the development roller 6, and the cleaning device 8 is disposed in the image forming apparatus 1.

The electrification roller 2 receives power supply from the power pack 3, and the photoconductor drum 4 is charged to desired electric potential by the electrification roller 2. The photoconductor drum 4 rotates in the direction arrow A by a driving mechanism (not shown). The surface electrometer 5 is provided just behind the electrification roller 2 along the rotation direction of the photoconductor drum 4, and measures the electric potential of the surface 4*a* of the photoconductor drum 4.

The toner is transferred on the charged photoconductor drum 4 by the development roller 6, and the toner transferred on the photoconductor drum 4 is transferred to a recording paper S by the transcription roller 7. The cleaning device 8 eliminates the toner remained on the photoconductor drum 4, and cleans the photoconductor drum 4.

In an image forming process by the image forming apparatus 1, at first, the electrification roller 2 charges the surface 4*a* of the photoconductor drum 4 to negative high potential. Next, exposure L, which is made of reflection light from a manuscript or laser beam, is irradiated on the charged surface 4*a*. The exposure L comprises light intensity distribution depending upon black/white of an image to be formed, and electric potential distribution corresponding to the light intensity distribution, i.e. an electrostatic latent image is formed on the surface 4*a* by reducing the electric potential (negative electric potential) of each part on the surface 4*a* in accordance with the amount of received light.

If the photoconductor drum 4 rotates, and the part on which the electrostatic latent image of the surface 4*a* is formed passes the development roller 6, the toner depending upon the electric potential distribution is transferred on the surface 4*a*, and then the electrostatic latent image is visualized as the toner image. The toner image is printed by the transcription roller 7 on the recording paper S fed by a predetermined timing, and the recording paper S is conveyed in the direction arrow B toward a fixing unit (not shown).

Meantime, the photoconductor drum 4 after being transferred is cleaned by eliminating the toner remained on the surface 4*a* with the cleaning member 8. The photoconductor drum 4 after being transferred moves to a next image forming process by eliminating remaining electric charge with a quenching lamp (not shown).

There has been known a contact-electrifying method which brings the electrification roller 2 into contact with the photoconductor drum 4 as a general electrification method in the above image forming apparatus (for example, reference to JP-A-S63-149668, JP-A-H01-211779, and JP-A-H01-267667).

However, there were following problems when the electrification roller 2 comprising the contact-electrifying method was used.

(1) If the structure material of the electrification roller is adhered to the surface of the photoconductor drum by leaking from the electrification roller, the imprint of the electrification roller is remained on the surface of the photoconductor drum by this adhesion.

(2) When alternating voltage is applied to the electrification roller, the electrification roller, which makes contact with the photoconductor drum, is vibrated, resulting in electrification noise.

(3) The toner on the surface of the photoconductor drum is transferred to the electrification roller whereby the electrification performance is decreased. Especially in the electrification roller, if the leakage of (1) generates, the toner becomes easy onto transfer to the electrification roller.

(4) The material, which constitutes the electrification roller, is easy to be transferred onto the photoconductor.

(5) If the photoconductor drum is not driven for a long time, the electrification roller is permanently deformed.

In order to handle the above problems, there has been developed a proximity-electrifying method by which the electrification roller 2 is brought close to the photoconductor drum 4 without making contact with the photoconductor drum 4 (reference to JP-A-H03-240076). With this proximity-electrifying method, the electrification roller 2 and the photoconductor drum 4 are faced to have the closest distance between them (hereinafter referred to as a space) of 0.05 to 0.3 mm, and voltage is applied to the electrification roller 2 to charge the photoconductor drum 4. The electrification roller 2 does not bring into contact with the photoconductor drum 4 by the proximity-electrifying method, so that the problems such as the adhesion of the structure material of the electrification roller to the photoconductor drum and the permanent deformation of the electrification roller generated by a long time nonuse, which are caused by the contact-electrifying method, are not problems for the proximity-electrifying method. Moreover, regarding to the prevention of the decrease in the electrification performance of the electrification roller by the adhesion of toner, the proximity-electrifying method is superior to the contacting-electrifying method since the toner transferred onto the electrification roller is decreased.

In order to achieve the proximity-electrifying method, there has been developed a method for providing a fixed interval space between an electrification roller and a photoconductor drum by winding space holding means of tape having a predetermined thickness to the both end portions of the electrification roller, for example JP-A-H05-107871. However, there was a problem that the fixed interval space between the photoconductor drum and the electrification roller was hard to be maintained by the wear of the tape member, the entrance and fixation of the toner between the electrification roller and the tape member, and the like, when the electrification roller was used for a long time.

Moreover, there has been considered a method for using a metal ring instead of using the tape member in order to prevent the wear of tape member. With this method, the photoconductor drum is remarkably worn, so that current is shorted between the base metal of the photoconductor and the metal ring, resulting in defects such as blowout of a power pack (power source for applying voltage).

Furthermore, in order to maintain the space between the electrification roller and the photoconductor drum, there has been developed a method for providing spacer ring layers to the both end portions of the electrification roller, for example JP-A-H03-240076, JP-A-H04-358175. However, in these publications, a specific method for maintaining a fixed interval space having good accuracy is not disclosed, and there was a problem that the fixed interval space was changed by the variation of dimensional accuracy of the electrification roller and the spacer ring layer whereby the electrification potential of the photoconductor drum did not become a constant.

SUMMARY OF THE INVENTION

The present invention has been made in view of aforementioned problems. It is, therefore, an object of the present invention to provide a highly durable conductive member capable of maintaining a space with a photoconductor, which has a constant interval and good accuracy, a process cartridge and an image forming apparatus using the conductive member.

In order to solve the above problems, according to an aspect of the present invention, there is provided a conductive member comprising a conductive supporting body, an electric resistance adjusting layer disposed on a surface of the conductive supporting body, and a space adjusting mechanism including a material different from the electric resistance adjusting layer, which is disposed on the surface of the conductive supporting body and is firmly fixed to an end portion of the electric resistance adjusting layer, wherein the space adjusting mechanism is provided to form a space between an outer surface of the electric resistance adjusting layer and an outer surface of a photoconductor. According to another aspect of the present invention, there is provided the conductive member, wherein the space adjusting mechanism comprises a pair of space holding members.

According to another aspect of the present invention, there is provided the conductive member, wherein after the space holding member and the electric resistance adjusting layer have been disposed in the conductive supporting body, the vertical interval is formed on the outer surface of the space holding member and the outer surface of the electric resistance adjusting layer by an elimination processing in order to improve an interval accuracy of the space.

According to still another aspect of the present invention, there is provided the conductive member, wherein the space holding member comprises an insulative part at least for the end portion adjacent to the electric resistance adjusting layer.

According to further aspect of the present invention, there is provided the conductive member, wherein the outer surface of the electric resistance adjusting layer is formed with a surface layer for preventing adhesion of toner.

According to still further aspect of the present invention, there is provided the conductive member, wherein resistance of the surface layer is larger than resistance in the electric resistance adjusting layer.

According to another aspect of the present invention, there is provided the conductive member, wherein the electric resistance adjusting layer and the space holding member comprise a cylindrical shape including the conductive supporting body as the central axis.

According to another aspect of the present invention, there is provided the conductive member, wherein the conductive member is used as an electrification member in an image forming apparatus.

According to another aspect of the present invention, there is provided a process cartridge for an image forming apparatus comprising the conductive member of the present invention.

According to another aspect of the present invention, there is provided an image forming apparatus comprising the conductive member of the present invention.

BRIEF DESCRIPTION OF THE DRAWINGS

FIG. 7A shows before the elimination processing; FIG. 7B shows after the elimination processing.

FIG. 9A shows before the elimination processing; FIG. 9B shows after the elimination processing.

DETAILED DESCRIPTION OF THE PREFERRED EMBODIMENTS

Hereinafter, a conductive member according to the present invention will be described with reference to the drawings.

Figure 3:
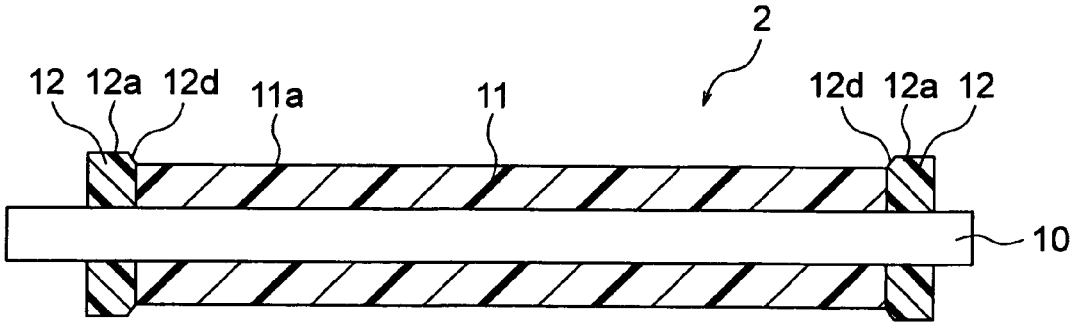
FIG. 3 is a cross section view showing the electrification roller (conductive member) according to the present invention.

FIG. 3 is a cross section view illustrating a structure of a conductive member used as an electrification roller 2 of an image forming apparatus 1. The specific structure of the image forming apparatus 1 is the same as the contents explained in the related art with FIG. 1, so here, the specific description of the image forming apparatus 1 will be omitted.

The electrification roller 2 is an electrification roller of a proximity-electrifying method. The electrification roller 2 comprises a conductive supporting body 10, a resistance adjusting layer 11, and a space adjusting mechanism for example, space holding members 12. The conductive supporting body 10 is a long cylindrical shape and a power pack 3 (power source for applying voltage) for applying voltage to the electrification roller 2 is connected to the end of the conductive supporting body 10.

The resistance adjusting layer 11 is a cylindrical layer disposed on the circumference surface of the conductive supporting body 10 adopting the conductive supporting body 10 as the central axis. The space holding member 12 is a cylindrical member disposed on the circumference surface of the conductive supporting body 10 adopting the conductive supporting body 10 as the central axis.

Figure 4:
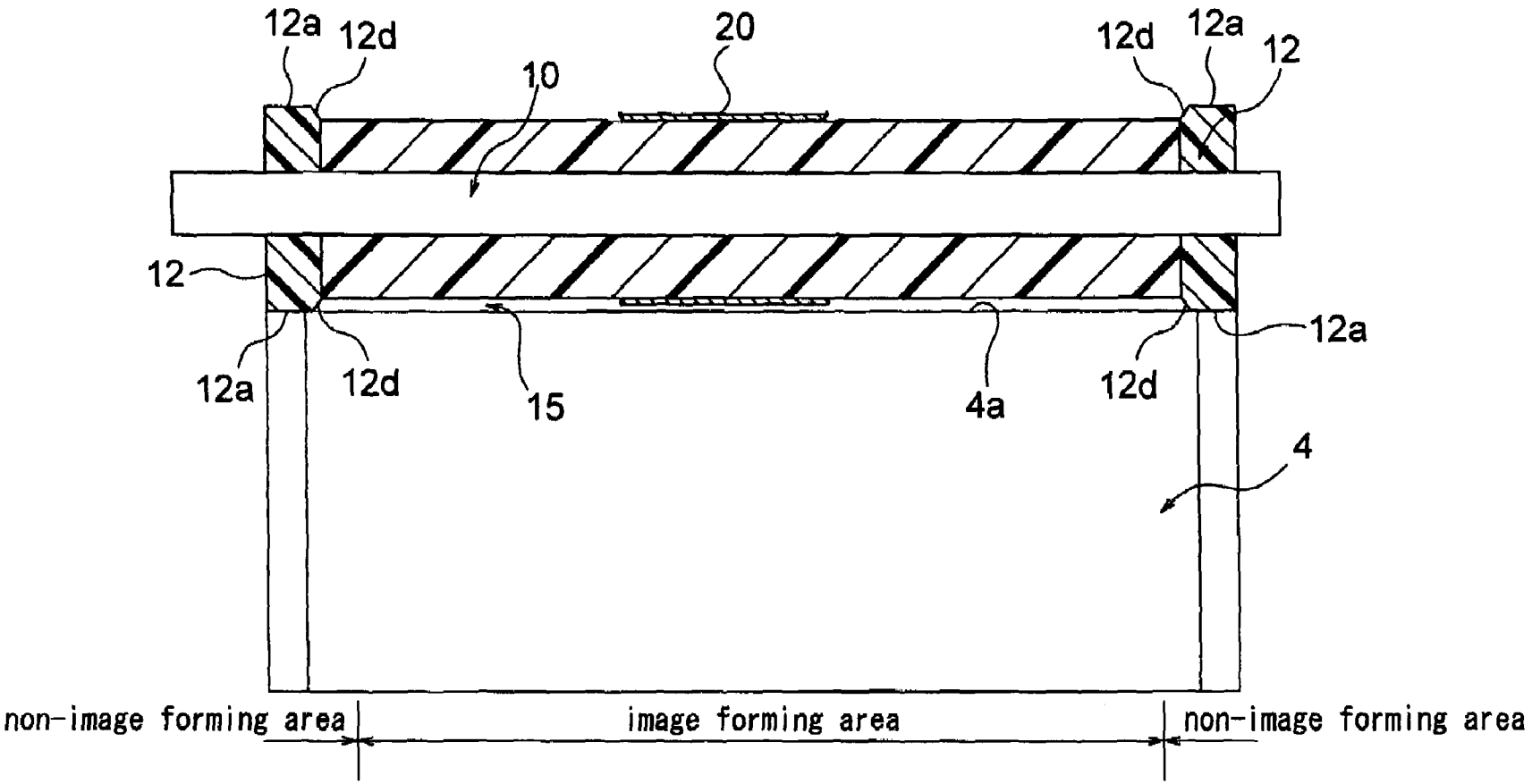
FIG. 4 is a cross section view showing the arrangement relationship between the electrification roller and the photoconductor drum according to the present invention.

FIG. 4 is a pattern view showing a state that the electrification roller 2 shown in FIG. 3 is arranged adjacent to a photoconductor drum 4. The space holding members 12 of the electrification roller 2 are disposed to make contact with the photoconductor drum 4 by arbitrary pressure. This electrification roller 2 is the proximity-electrifying method, and the external diameter of the resistance adjusting layer 11 is formed slightly smaller than the external diameter of the space holding member 12. The outer surface 12*a* of the space holding member 12 of the electrification roller 2 comes into contact with the outer surface 4*a* of the photoconductor drum 4, but a space 15 is formed between the outer surface 11*a* of the resistance adjusting layer 11 and the outer surface 4*a* of the photoconductor drum 4. The electrification roller 2 is allocated such that the space holding member 12 comes into contact with the area in addition to the image forming area of the photoconductor drum 4 (non-image forming area). Voltage is applied to the electrification roller 2 with this state, so that the photoconductor drum 4 can be charged by the electrification roller 2.

The photoconductor drum 4 is a cylindrical shape. By rotating the electrification roller 2 and the photoconductor drum 4, the surfaces facing each other can be changed in accordance with the rotation, so that chemical deterioration on the surfaces caused by the stress generated by the power distribution is hard to generate, and the product cycle can be improved. The photoconductor drum 4 and the electrification roller 2 are not necessary to be cylindrical shapes, and they may be elliptic cylindrical shapes.

In the electrification roller 2, the interval of the space 15 should be maintained at predetermined interval in order to adopt the proximity-electrifying method. Accordingly, if the outer surfaces of the image forming area and the non-image forming area of the photoconductor drum 4 have the same height as shown in FIG. 4, the height of the space holding member 12 contacting with the photoconductor drum 4 (the external diameter of the central axis of the conductive supporting body) should be higher than the height of the outer surface of the resistance adjusting layer 11 (the external diameter from the central axis of the conductive supporting body), and it is preferable for the vertical interval, in other words, the interval of the space 15 to be equal or less than 0.1 mm. This is because if the interval of the space 15 becomes larger, condition for applying voltage to the electrification roller should be increased, and the electrical deterioration and the abnormal electric discharge of the photoconductor drum 4 are easy to generate.

If the height of the space holding member 12 adjacent to the resistance adjusting layer 11 is manufactured to be shorter than the other portion of the space holding member 12, the contact width between the outer surface 12*a* of the space holding member 12 and the outer surface 4*a* of the photoconductor drum is decreased, and the interval of the space 15 between the resistance adjusting layer 11 and the photoconductor drum 4 can be maintained at high accuracy.

Figure 5:
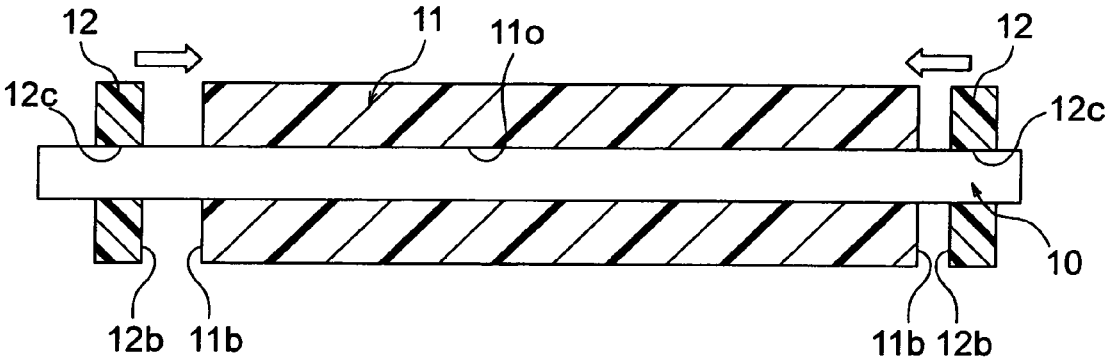
FIG. 5 is a cross section view showing the attachment process of the resistance adjusting layer and the space holding member in the electrification roller according to the present invention.

Next, a method for forming the space in the electrification roller 2 will be explained. Firstly, in the electrification roller, the conductive supporting body 10 is inserted to an insertion hole 11*o* of the resistance adjusting layer 11 having a cylindrical shape as shown in FIG. 5, and then the space holding members 12 are fitted from the both end of the resistance adjusting layer 11. Here, adhesive agent is applied among the end face 12*b* of the space holding member 12, the end face 11*b* of the resistance adjusting layer 11, the circumference surface of the conductive supporting body 10, and the internal surface 12*c* of the insertion hole in the space holding member 12, so that the space holding member 12 can not be easily dropped off by using.

For the electrification roller 2 of which the resistance adjusting layer 11 and the space holding member 12 are installed to the conductive supporting body 10, an elimination processing is consecutively applied to the outer surface 12*a* of the space holding member 12 and the outer surface 11*a* of the resistance adjusting layer 11. Here, the elimination processing means a process for performing a surface adjusting process of the outer surface by a cutting process, grinding process, or the like. The elimination processing also means an operation for adjusting a vertical interval between the height of the outer surface 12*a* of the space holding member 12 and the height of the outer surface 11*a* of the resistance adjusting layer 11. The variation of the vertical interval can be controlled equal or less than ±0.01 mm by this elimination processing.

Figure 6:
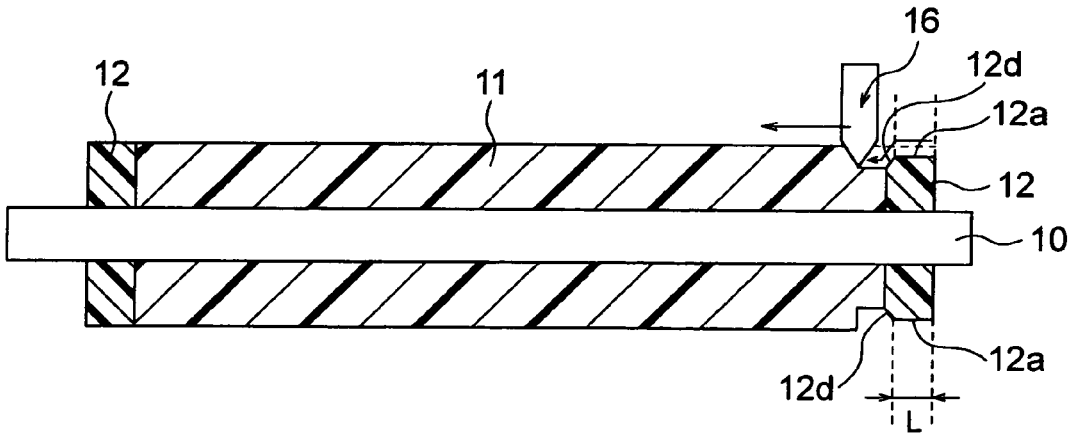
FIG. 6 is a cross section view illustrating a process for performing the elimination processing in the electrification roller in which the resistance adjusting layer and the space holding member are disposed.

More specifically, as shown in FIG. 6, at first, the outer circumference surface 12*a* is horizontally cut from the end portion of the space holding member 12 for a fixed distance L by a cutting blade 16, and then the end portion 12*d* of the space holding member 12 adjacent to the resistance adjusting layer 11 is cut deeper than the outer surface 12*a* of the space holding member 12. After the elimination processing of which the end portion 12*d* of the space holding member 12 adjacent to the resistance adjusting member 11 is to be on the same plane with the outer surface 11*a* of the resistance adjusting portion 11 or to be lower than the outer surface 11*a* of the resistance adjusting member 11 is carried out, the elimination processing is carried out such that the outer surface 12*a* of the space holding member 12 maintains a fixed vertical interval with respect to the outer surface 11*a* of the resistance adjusting layer 11. The same elimination processing is applied with respect to the space holding member 12 disposed in the opposite side of the end portion of the resistance adjusting layer.

The space 15 is formed between the outer surface 12*a* of the space holding member 12 and the outer surface 11*a* of the resistance adjusting layer 11 by conducting such a process. In the space holding member, since the outer surface of the end portion 12*d* of the resistance adjusting layer 11 side is lower than the outer surface 12*a* of the space holding member 12, the outer surface of the end portion 12*d* of the resistance adjusting layer 11 side can be prevented from contacting to the photoconductor drum 4, and the generation of shorted current caused by the contact of the resistance adjusting layer 11 adjacent through the end portion 12*d* to the photoconductor drum 4 can be controlled. By manufacturing the end portion 12*d* of the resistance adjusting layer 11 side of the space holding member 12 to be lower than the outer surface 12*a* of the space holding member 12, this portion can be used as relief allowance (relief process) of the cutting blade 16 and the like when performing the elimination processing. The end portion 12*d* of the space holding member 12 does not abut on the photoconductor drum 4, so that the contact width between the outer surface 12*a* of the space holding member 12 and the outer surface 4*a* of the photoconductor drum 4 becomes narrower, and a higher accurate space can be easily maintained since the change of the space interval depending upon the change of the contact portion is decreased.

The shape of the relief (relief process) can be any shape as long as the outer circumference surface of the end portion 12*d* of the space holding member 12 does not make contact with the photoconductor drum 4.

It is preferable for the space holding member 12 to be an insulative material in order to prevent the generation of short-circuit current caused by the short-circuit between the space holding member 12 and the base layer of the photoconductor drum 4 when the space holding member 12 makes contact with the photoconductor drum 4. Especially, it is preferable for the insulative member of the space holding member 12 to have volume resistivity value of equal or more than $10^{13}$ Ωcm. The whole portion of the space holding member 12 should not be an insulative material, and if the space holding member 12 has insulation performance at least in the contact portion with the resistance adjusting layer 11, the generation of the short-circuit current can be prevented.

The material of the space holding member 12 is not limited to another material in addition to the insulative material; it is preferable for the material of the space holding member 12 to be a soft material which does not scratch the photoconductor drum 4 and to be thermoplastic resin and the like such as high-density polyethylene due to the easiness of forming process and the like.

The resistance adjusting layer 11 is formed by thermoplastic resin composite of which high-molecular form ionic conductive material is dispersed. If the volume resistivity value of the resistance adjusting layer 11 exceeds $10^9$ Ωcm, the electrification performance and the transcription performance become insufficient. If the volume resistivity value is lower than $10^6$ Ωcm, leakage is generated by voltage concentrated to the whole photoconductor drum 4. Accordingly, it is preferable for the volume resistivity value of the resistance adjusting layer 11 to be from $10^6$ to $10^9$ Ωcm.

The thermoplastic resin used for the resistance adjusting layer 11 is not specially limited, but it is more preferable if the thermoplastic resin is commodity resin such as polyethylene resin (PE), polypropylene (PP), polymethylmethacrylate (PMMA), polystyrene (PS), and copolymer thereof (AS, ABS) because of the easiness of the molding process. As high-molecular form ionic conductive material which is dispersed in the thermoplastic resin, high polymer compound containing polyetheresteramide component is preferable. Polyetheresteramide is ionic conductive high polymer material, and is uniformly dispersed and fixed at the molecular level in matrix polymer. Accordingly, variation of resistance value with dispersion defect as shown in composite in which conductive pigment is dispersed does not generate. Since polyetheresteramide is high polymer material, it is hard to generate bleed-out. Regarding the blending quantity, it is necessary to have 30–70 wt. % of thermoplastic resin and 70–30 wt. % of high-molecular form ionic conductive material since the resistance value is required to be a desired value.

It is not especially limited for a manufacturing method of resin composite, and the resin composite can be easily manufactured by melting and kneading the mixture of each material with a two axes kneading machine, a kneader, and the like. A process for forming the resistance adjusting layer 11 on the circumference surface of the conductive supporting body 10 can be easily carried out by covering the conductive supporting body 10 with the above semi-conductive resin composite by using means such as extrusion molding and injection molding.

If the electrification roller 2 is constituted by forming only the resistance adjusting layer 11 on the conductive supporting body 10, the performance of the electrification roller 2 may be decreased by the fixation of toner to the resistance adjusting layer 11. In order to prevent such a defect, a surface layer 20 (shown in FIG. 4) is formed on the outer surface of the resistance adjusting layer 11 for preventing the fixation of toner. The defect generated by the fixation of toner from the surface of photoconductor drum 4 to the surface of the resistance adjusting layer 11 can be prevented by forming the surface layer 20, and the product life of the electrocution roller 2 can be improved.

The resistance value of the surface layer is formed to be larger than the resistance value of the resistance adjusting layer 11, and voltage concentration and abnormal electric discharge (leakage) to a defective portion of the photoconductor drum are avoidable by the difference of the resistance value. If the resistance value of the surface layer is too high, electrification ability and transcription ability are lacked, so that it is preferable for the difference of the resistance value between the surface layer and the resistance adjusting layer 11 to be equal or less than $10^3$ Ωcm.

As a material for forming the surface layer, it is suitable to use thermoplastic resin composite in terms of good film forming performance. As the resin material, fluorocarbon resin, silicone resin, polyamide resin, polyester resin, and the like are superior in non-adherence, and are preferable for preventing the fixation of toner. Since resin material is electrically insulated, the resistance of surface layer can be adjusted by dispersing various conductive materials with respect to the resin material. A process for forming the surface layer on the resistance adjusting layer 11 is conducted in such a manner that coating material is made by dispersing the material for constituting the above surface layer in organic solvent, and then the resistance adjusting layer 11 is coated by spray coating, dipping, and the like. It is preferable for the thickness of the surface layer is about 0.01 to 0.03 mm.

Hereinafter, image forming processes are compared by using a plurality of embodiments 1 to 6 and comparative examples 1 to 3 which has the above electrification roller and uses different materials for the electrification roller.

(First Embodiment)

Figures 7A, 7B:
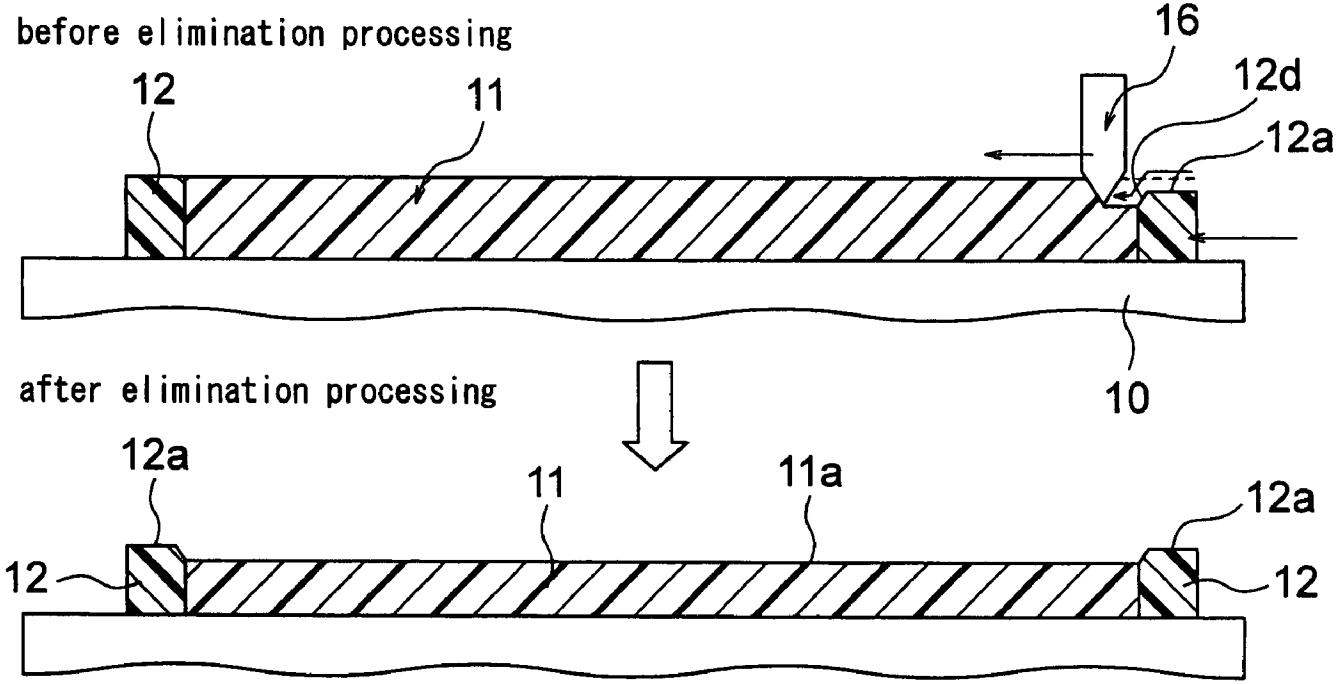
FIGS. 7A, 7B are enlarged cross section views illustrating a process of elimination processing for the electrification roller according to the first embodiment.
Figure 8:
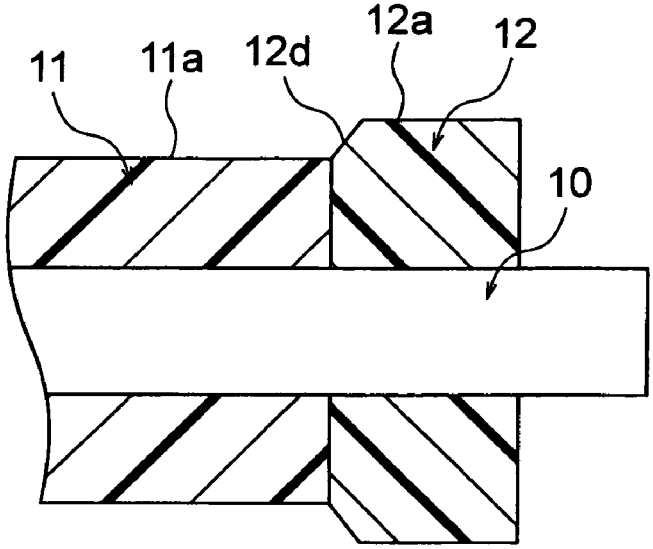
FIG. 8 is an enlarged cross section view illustrating the end portion of the electrification roller according to the first embodiment.

The core axis (conductive supporting body 10: external diameter 8 mm) comprising stainless-steel is covered with the resin composite of the resistance adjusting layer 11 (volume resistivity value: $2\times10^8$ Ωcm) comprising 50 wt. % of ABS resin (DENKA ABS GR-0500, DENKI KAGAKU KOGYO) and 50 wt. % of polyetheresteramide (IRGASTAT P18 CHIBA Specialty Chemicals) by injection molding. Next, the ring shaped space holding member 12 comprising high-density polyethylene resin (Novatech PP HY540, Japan Polychem Corp.) is inserted and is bonded to the both end portions thereof. The outer diameter (the most outer diameter) of the space holding member 12 is grinded to be 12.12 mm and the outer diameter of the resistance adjusting layer is grinded to be 12.00 mm as shown in FIG. 7. At the same time, a finishing process is conducted for both the space holding member and the resistance adjusting layer, and then the form shown in FIG. 8 is obtained. Next, the surface layer of about 0.01 mm film thickness is formed on the surface of the resistance adjusting layer 11 by the mixture (surface resistance: $2\times10^9$ Ω) comprising acrylic silicon resin (3000VH-P Kawakami Paint), isocyanete based curing agent, and carbon black (35 wt. % with respect to the whole solid content).

(Second Embodiment)

Figure 10:
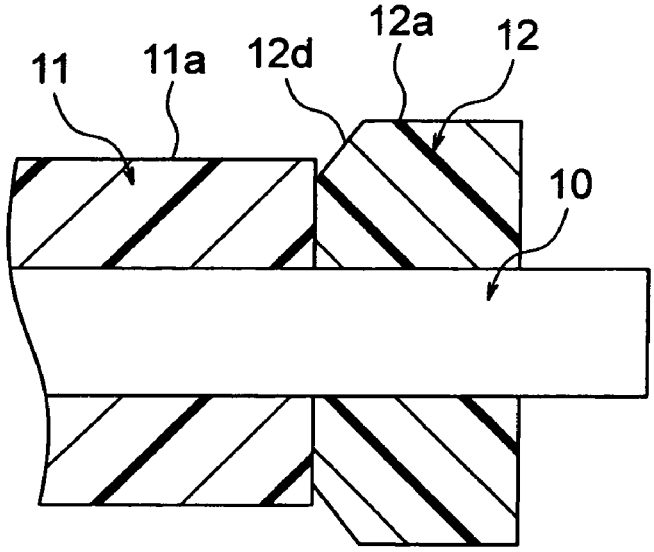
FIG. 10 is an enlarged cross section view showing the end portion of the electrification roller according to the second embodiment.
Figures 9A, 9B:
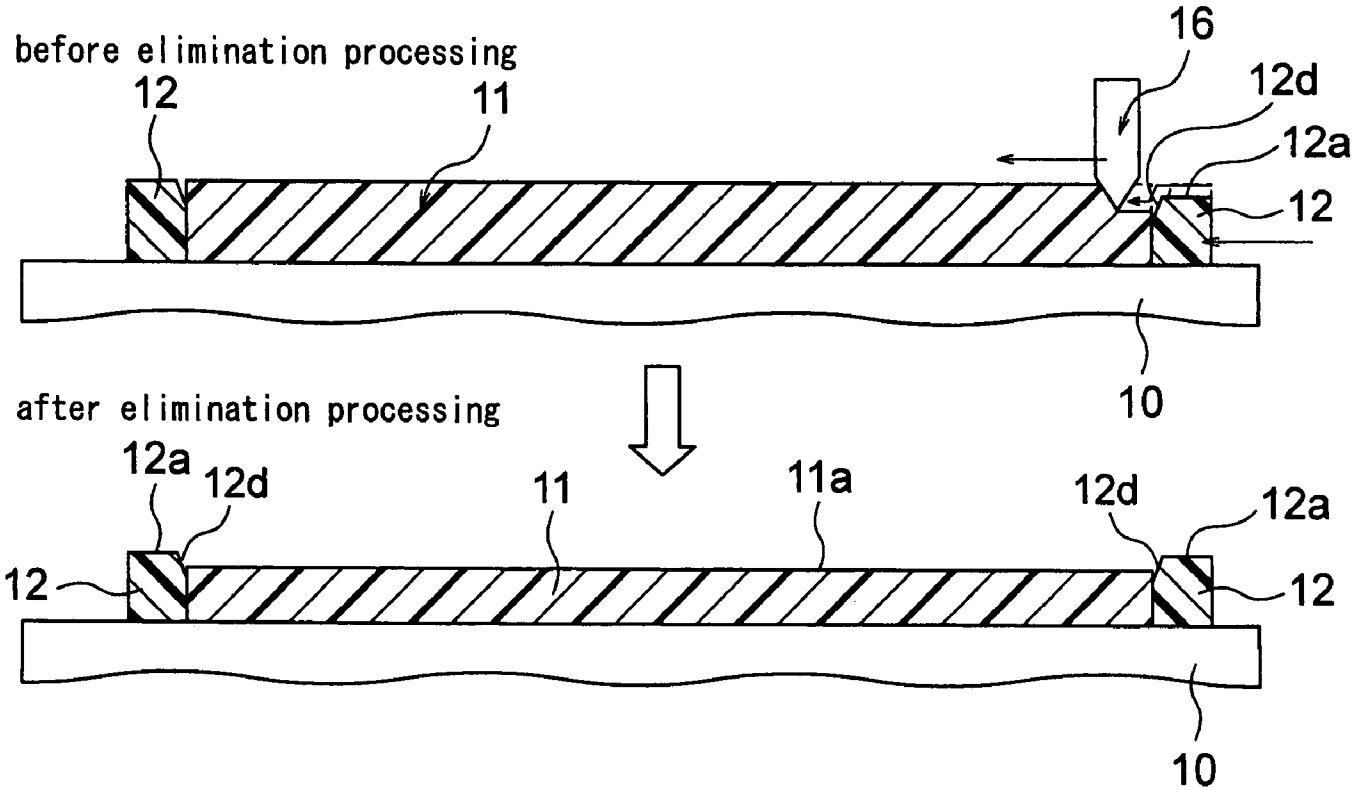
FIGS. 9A, 9B are enlarged cross section views showing a process of elimination processing for the electrification roller according to the present invention.

The core axis (conductive supporting body 10: external diameter 8 mm) comprising stainless-steel is covered with the resin composite of the resistance adjusting layer 11 (volume resistivity value: $2\times10^8$ Ωcm) comprising 50 wt. % of ABS resin (DENKA ABS GR-0500, DENKI KAGAKU KOGYO) and 50 wt. % of polyetheresteramide (IRGASTAT P18 CHIBA Specialty Chemicals) by injection molding. Next, the ring shaped space holding member 12 comprising high-density polyethylene resin (Novatech PP HY540, Japan Polychem Corp.) is inserted and is bonded to the both end portions thereof. The outer diameter (the most outer diameter) of the space holding member 12 is grinded to be 12.12 mm and the outer diameter of the resistance adjusting layer 11 is grinded to be 12.00 mm as shown in FIG. 9. At the same time, a finishing process is conducted for both the space holding member and the resistance adjusting layer, and then the form shown in FIG. 10 is obtained. Next, the surface layer of about 0.01 mm film thickness is formed on the surface of the resistance adjusting layer 11 by the mixture (surface resistance: $2\times10^9$ Ω) comprising acrylicsilicon resin (3000VH-P Kawakami Paint), isocyanete based curing agent, and carbon black (35 wt. % with respect to the whole solid content).

(Third Embodiment)

Figure 11:
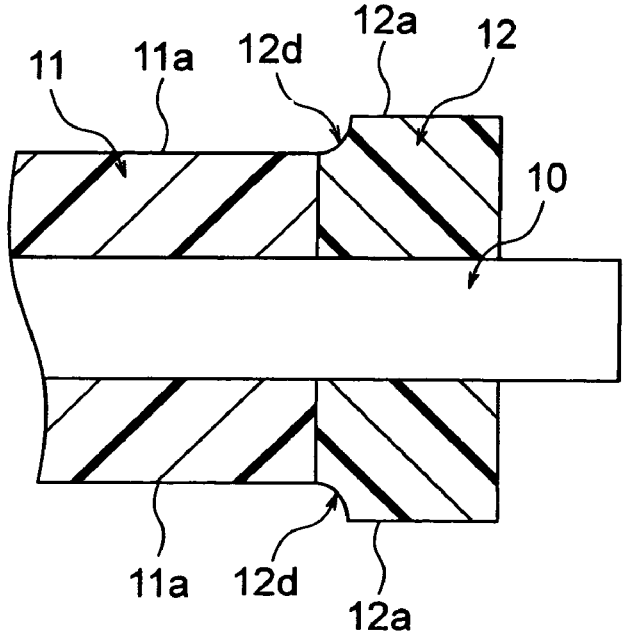
FIG. 11 is an enlarged cross section view illustrating the end portion of the electrification roller according to the third embodiment.

The core axis (conductive supporting body 10: external diameter 8 mm) comprising stainless-steel is covered with the resin composite of the resistance adjusting layer 11 (volume resistivity value: $2\times10^8$ Ωcm) comprising 50 wt. % of ABS resin (DENKA ABS GR-0500, DENKI KAGAKU KOGYO) and 50 wt. % of polyetheresteramide (IRGASTAT P18 CHIBA Specialty Chemicals) by injection molding. Next, the ring shaped space holding member 12 comprising high-density polyethylene resin (Novatech PP HY540, Japan Polychem Corp.) is inserted and is bonded to the both end portions thereof. The outer diameter (the most outer diameter) of the space holding member 12 is grinded to be 12.12 mm and the outer diameter of the resistance adjusting layer 11 is grinded to be 12.00 mm. At the same time, a finishing process is conducted for both the space holding member and the resistance adjusting layer, and then the form shown in FIG. 11 is obtained. Next, the surface layer of about 0.01 mm film thickness is formed on the surface of the resistance adjusting layer 11 by the mixture (surface resistance: $2\times10^9$ Ω) comprising acrylicsilicon resin (3000VH-P Kawakami Paint), isocyanete based curing agent, and carbon black (35 wt. % with respect to the whole solid content).

(Fuorth Embodiment)

Figure 12:
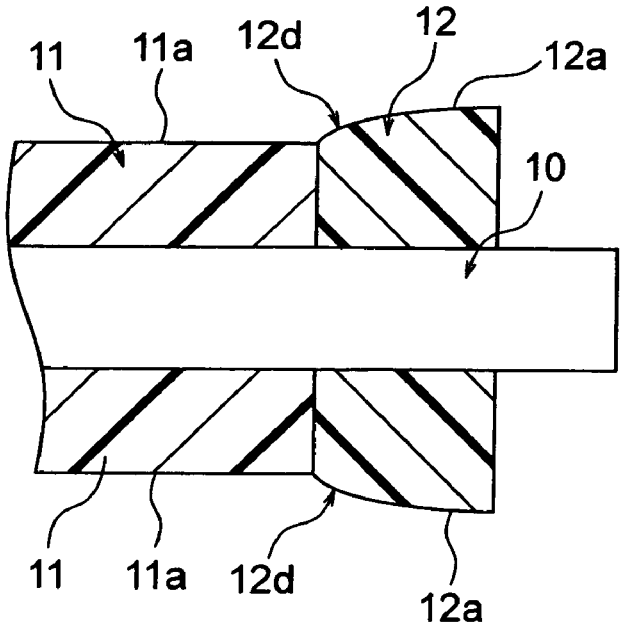
FIG. 12 is an enlarged cross section view illustrating the end portion of the electrification roller according to the fourth embodiment.

The core axis (conductive supporting body 10: external diameter 8 mm) comprising stainless-steel is covered with the resin composite of the resistance adjusting layer (volume resistivity value: $2\times10^8$ Ωcm) comprising 50 wt. % of ABS resin (DENKA ABS GR-0500, DENKI KAGAKU KOGYO) and 50 wt. % of polyetheresteramide (IRGASTAT P18 CHIBA Specialty Chemicals) by injection molding. Next, the ring shaped space holding member 12 comprising high-density polyethylene resin (Novatech PP HY540, Japan Polychem Corp.) is inserted and is bonded to the both end portions thereof. The outer diameter (the most outer diameter) of the space holding member 12 is grinded to be 12.12 mm and the outer diameter of the resistance adjusting layer 11 is grinded to be 12.00 mm. At the same time, a finishing process is conducted for both the space holding member and the resistance adjusting layer, and then the form shown in FIG. 12 is obtained. Next, the surface layer of about 0.01 mm film thickness is formed on the surface of the resistance adjusting layer by the mixture (surface resistance $2\times10^9$ Ω) comprising acrylicsilicon resin (3000VH-P Kawakami Paint), isocyanete based curing agent, and carbon black (35 wt. % with respect to the whole solid content).

(Fifth Embodiment)

Figure 13:
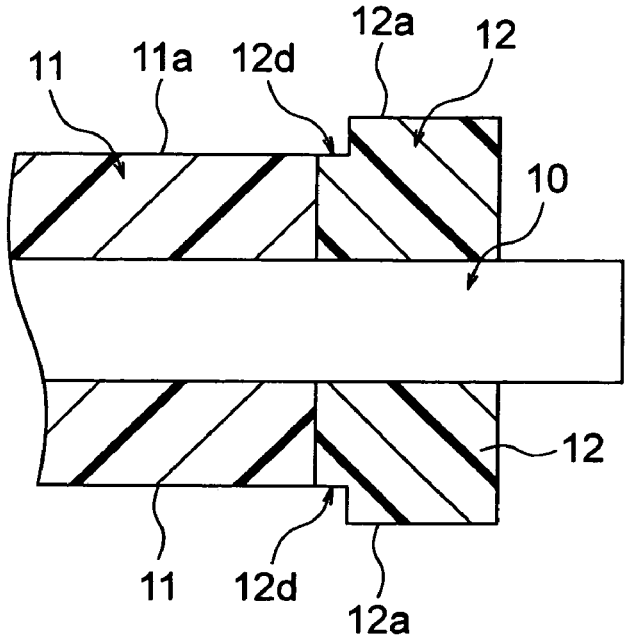
FIG. 13 is an enlarged cross section view showing the end portion of the electrification roller according to the fifth embodiment.

The core axis (conductive supporting body 10: external diameter 8 mm) comprising stainless-steel is covered with the resin composite of the resistance adjusting layer 11 (volume resistivity value: $2\times10^8$ Ωcm) comprising 50 wt. % of ABS resin (DENKA ABS GR-0500, DENKI KAGAKU KOGYO) and 50 wt. % of polyetheresteramide (IRGASTAT P18 CHIBA Specialty Chemicals) by injection molding. Next, the ring shaped space holding member 12 comprising high-density polyethylene resin (Novatech PP HY540, Japan Polychem Corp.) is inserted and is bonded to the both end portions thereof. The outer diameter (the most outer diameter) of the space holding member 12 is grinded to be 12.12 mm and the outer diameter of the resistance adjusting layer 11 is grinded to be 12.00 mm. At the same time, a finishing process is conducted for both the space holding member and the resistance adjusting layer, and then the form shown in FIG. 13 is obtained. Next, the surface layer of about 0.01 mm film thickness is formed on the outer surface of the resistance adjusting layer 11 by the mixture (surface resistance: $2\times10^9$ Ω) comprising acrylicsilicon resin (3000VH-P Kawakami Paint), isocyanete based curing agent, and carbon black (35 wt. % with respect to the whole solid content).

(Sixth Embodiment)

Figure 14:
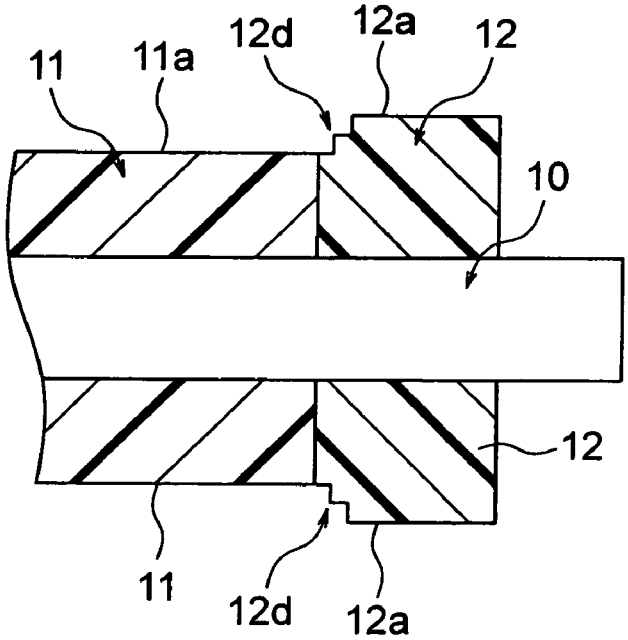
FIG. 14 is an enlarged cross section view showing the end portion of the electrification roller according to the sixth embodiment.

The core axis (conductive supporting body 10: external diameter 8 mm) comprising stainless-steel is covered with the resin composite of the resistance adjusting layer 11 (volume resistivity value: $2\times10^8$ Ωcm) comprising 50 wt. % of ABS resin (DENKA ABS GR-0500, DENKI KAGAKU KOGYO) and 50 wt. % of polyetheresteramide (IRGASTAT P18 CHIBA Specialty Chemicals) by injection molding. Next, the ring shaped space holding member 12 comprising high-density polyethylene resin (Novatech PP HY540, Japan Polychem Corp.) is inserted and is bonded to the both end portions thereof. The outer diameter (the most outer diameter) of the space holding member 12 is grinded to be 12.12 mm and the outer diameter of the resistance adjusting layer 11 is grinded to be 12.00 mm. At the same time, a finishing process is conducted for both the space holding member and the resistance adjusting layer, and then the form shown in FIG. 14 is obtained. Next, the surface layer of about 0.01 mm film thickness is formed on the surface of the resistance adjusting layer 11 by the mixture (surface resistance: $2\times10^9$ Ω) comprising acrylicsilicon resin (3000VH-P Kawakami Paint), isocyanete based curing agent, and carbon black (35 wt. % with respect to the whole solid content).

COMPARATIVE EXAMPLE 1

The core axis (outer diameter 8 mm) comprising stainless-steel is covered with the rubber composite (volume resistivity value: $4\times10^8$ Ωcm) of the resistance adjusting layer in which 3 pts.wt. of ammonium perchlorate is compounded to 100 pts.wt. of epichlorohydrin-rubber (EPICHLOMER CG, DAISO CO., LTD.) by extrusion molding and vulcanization processes, and then is finished to have the external diameter of 12 mm by grinding. Next, the surface layer having the film thickness of 0.01 mm is formed on the surface of the resistance adjusting layer by the mixture (surface resistance: $2\times10^{10}$ Ω) comprising polyvinylbutyral resin (DENKA BUTYRAL 3000-K, DENKA KAGAKU KOGYO), isocyanete based curing agent, and tin oxide (60 wt. % with respect to the whole solid content). Next, the tape member (DAITAC PF025-H, DAINIPPON INK AND CHEMICALS, INCORPORATED) having the thickness of 0.05 mm is attached to the circumferences of the both end portions thereof, and then the electrification roller is formed.

COMPRESSION EXAMPLE 2

The core axis (outer diameter 8 mm) is covered with the resin composite (volume resistivity value: $2\times10^8$ Ωcm) of the resistance adjusting layer comprising 50 wt. % of ABS resin (GR-0500, DENKI KAGAKU KOUGYO) and 50 wt. % of ionic conductive high-molecular compound containing quaternary ammonium base by injection molding, and then is finished to have the external diameter of 12.0 mm by a grinding process. Next, the surface layer having the film thickness of about 0.01 mm is formed on the surface of the resistance adjusting layer by the mixture (surface resistance: $2\times10^{10}$ Ω) comprising fluorocarbon resin (LUMIFLON LF-600, ASAHI GLASS CO., LTD.), isocyanete based curing agent, and tin oxide (60 wt. % with respect to the whole solid content). Next, the ring shaped space holding member (outer diameter 12.12 mm) comprising stainless-steel is inserted and is bonded to the both end portions thereof, and the electrification roller is formed.

COMPRESSION EXAMPLE 3

The core axis (external diameter 8 mm) comprising stainless-steel is covered with the resin composite (volume resistivity value: $2\times10^8$ Ωcm) of the resistance adjusting layer comprising 50 wt. % of ABS resin (DENKA ABS GR-0500, DENKI KAGAKU KOGYO) and 50 wt. % of polyetheresteramide (IRGASTAT P18, Chiba Specialty Chemicals) by injection molding, and then the outer diameter of 12.00 mm is obtained. Next, the surface layer having the film thickness of about 0.01 mm is formed on the surface of the resistance adjusting layer by the mixture (surface resistance: $2\times10^{10}$ Ω) comprising fluorocarbon resin (LUMIFULON LF-600, ASAH GLASS CO., LTD.), isocyanete based curing agent, and tin oxide (60 wt. % with respect to the whole solid content). Next, the ring shaped space holding member (external diameter 12.12 mm) comprising polyamide resin (NOVAMID 1010C2, Mitusubish Engineering-Plastic Corporation) is inserted and is boned to the both end portions thereof, and the electrification roller is formed.

(Test)

Figure 1:
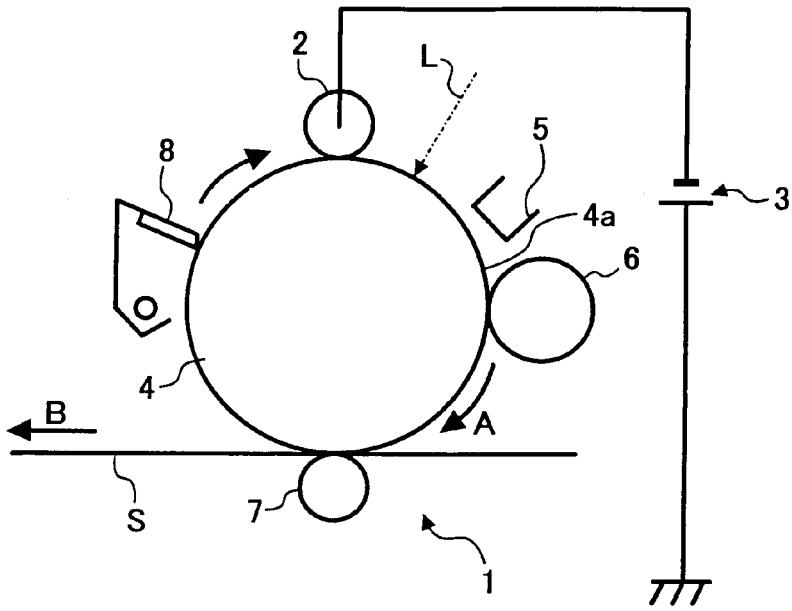
FIG. 1 is a schematic view illustrating a structure of a general image forming apparatus.
Figure 2:
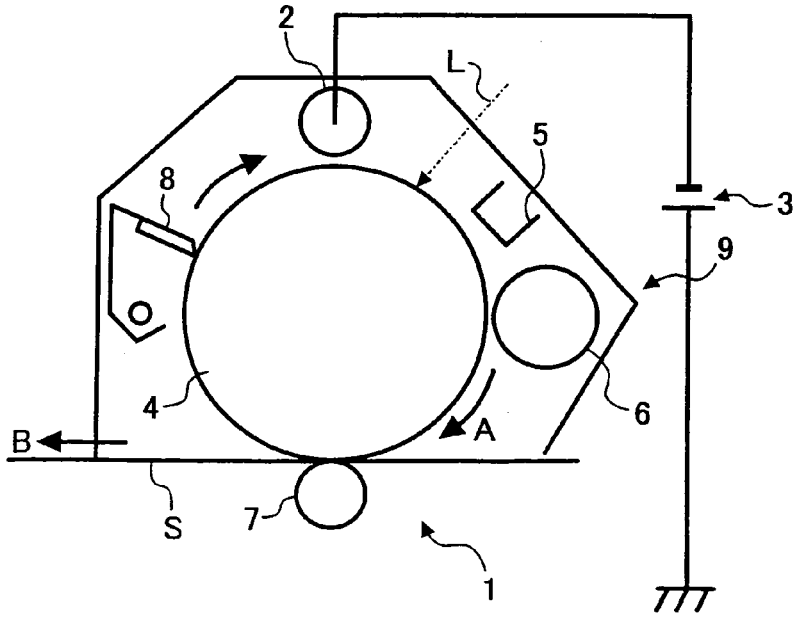
FIG. 2 is a schematic view illustrating a structure of image forming apparatus comprising a process cartridge.

The above mentioned electrification roller is mounted on the image forming apparatus shown in FIG. 1, and the interval of the space formed between the electrification roller and the photoconductor is measured.

Next voltage to be applied is set to DC=−800V and AC=2400 Vpp (frequency=2 kHz). The interval of the space between the electrification roller and the photoconductor, the state of the space holding member, and the printed image are evaluated after 600000 sheets of papers have been sent. The evaluation environment is 23° C. and 60% RH. Hereinafter, the evaluation results are shown in table 1.

TABLE 1

| | Amount of space between electrification member and photoconductor (mm) | Amount of space between electrification member and photoconductor after 600,000 sheets of papers have been sent. (mm) | State of space holding member after 600,000 sheets of papers have been sent. | Image after 600,000 sheets of papers have been sent. |
|---|---|---|---|---|
| Embodiment 1 | 0.05 ± 0.008 | 0.05 ± 0.008 | good | excellent |
| Embodiment 2 | 0.05 ± 0.008 | 0.05 ± 0.008 | good | excellent |
| Embodiment 3 | 0.05 ± 0.008 | 0.05 ± 0.008 | good | excellent |
| Embodiment 4 | 0.05 ± 0.008 | 0.05 ± 0.008 | good | excellent |
| Embodiment 5 | 0.05 ± 0.008 | 0.05 ± 0.008 | good | excellent |
| Embodiment 6 | 0.05 ± 0.008 | 0.05 ± 0.008 | good | excellent |

TABLE 1-continued

| | Amount of space between electrification member and photoconductor (mm) | Amount of space between electrification member and photoconductor after 600,000 sheets of papers have been sent. (mm) | State of space holding member after 600,000 sheets of papers have been sent. | Image after 600,000 sheets of papers have been sent. |
|---|---|---|---|---|
| Comparative example 1 | 0.03 ± 0.010 | Incapable measurement by the removed space holding member. | Removed Abrasion | Image irregularity |
| Comparative example 2 | During the evaluation, short circuit generates from the space holding member to the photoconductor, and stops the evaluation by the damage of a device for applying voltage. | | | |
| Comparative example 3 | 0.05 ± 0.030 | 0.04 ± 0.040 | Abrasion | Image irregularity |

As apparent from table 1, for the electrification rollers formed by the embodiments 1 to 6, excellent results were obtained in the all items. However, defects were seen for the electrification rollers formed by the comparative examples 1 to 3.

The embodiments using the conductive member according to the present invention as the electrification roller were described with reference to the drawings as described above. However the conductive member according to the present invention is not limited to the electrification member such as the electrification roller, and it may be a member used for transcription member such as a transcription roller. When the conductive member is used as a transcription member, the same effect can be obtained by using the transcription member with the same embodiment.

Moreover, the process cartridge of the image forming apparatus using the electrification member according to the present invention and the image forming apparatus itself can obtain the same effect.

According to the conductive member of the present invention, the space holding member which is firmly fixed to the end portion of the electric resistance adjusting layer is provided as a material different from the electric resistance adjusting layer. A vertical interval is provided between the outer surface of the space holding member and the outer surface of the electric resistance adjusting layer, so that the space interval between the electric resistance layer and the photoconductor can be maintained at constant with good accuracy. The end portion of the space holding member adjacent to the electric resistance layer is processed to avoid contact with the photoconductor, so that the width of which the outer circumference surface of the space holding member makes contact with the photoconductor can be narrowed. Accordingly, the contact area between the space holding member and the photoconductor becomes smaller, and the space interval can be easily maintained at constant with good accuracy since the change of the space interval by the change of the contact area is reduced.

According to the conductive member of the present invention, after the electric resistance adjusting layer and the space holding member are attached to the conductive supporting body, the vertical interval is adjusted by applying an elimination processing on the outer surfaces thereof, so that the interval accuracy of the space can be improved. When the elimination processing is carried out, the outer circumference surface of the end portion of the space holding member adjacent to the electric resistance adjusting layer can be processed to avoid contact with the photoconductor, and when the elimination operation such as grinding is conducted, this portion can be used as relief allowance (relief process) of a cutting blade, so the space interval can be maintained till the end portion of the outer surface with good accuracy.

According to the conductive member of the present invention, at least the end portion of the space holding member adjacent to the electric resistance adjusting layer comprises the insulative part, so it is possible to prevent the generation of the short-circuit current by which the electric resistance adjusting layer shorts with the photoconductor drum thorough the space holding member contacting to the photoconductor.

According to the conductive member of the present invention, since the outer surface of the electric resistance adjusting layer is formed with the surface layer for preventing the adhesion of the toner, the defect by which the toner on the surface of the photoconductor is adhered to the surface of the electric resistance adjusting layer can be controlled, and the product life of the conductive member can be improved.

Especially, as described above, if the resistance of the surface layer is larger than the resistance in the electric resistance adjusting layer, the abnormal electric discharge and the voltage concentration from the conductive member to the photoconductor are avoidable.

According to the conductive member of the present invention, the electric resistance adjusting layer and the space holding member comprise a cylindrical shape including the conductive supporting body as the central axis, so that the conductive member can be used by rotating the conductive supporting body as the rotation axis.

According to the conductive member of the present invention, an excellent image quality can be obtained for a long time by using the conductive member of the present invention as the electrification member of the proximity-electrifying method.

According to the present invention, the process cartridge capable of obtaining an excellent image quality for a long time can be provided. Moreover, according to the present invention, the image forming apparatus capable of obtaining an excellent image quality for a long time can be provided.

What is claimed is:

1. A conductive member, comprising:

a tubular conductive supporting body, which is disposed close to a photoconductor having non-image forming areas on both end portions and an image forming area on an intermediate portion;

an electric resistance adjusting layer, which is disposed on a surface of the intermediate portion except for the end portion of the conductive supporting body;

a pair of space adjusting members including a material different from the electric resistance adjusting layer, which are disposed on the both end portions of the conductive supporting body, wherein one end surface of a pair of end surfaces facing each other in an axis line in each of the space adjusting members, which is positioned in an electric resistance adjusting layer side is firmly fixed to an end surface of the electric resistance adjusting layer, an outer circumferential surface of each of the space adjusting members abuts on an outer circumferential surface in each of the non-image forming areas of the photo conductor, an outer diameter of each of the space adjusting members is set larger than an outer diameter of the electric resistance adjusting layer to form a space between an outer surface of the electric resistance adjusting layer and an outer surface of the photoconductor in a state that the outer circumferential surface of each of the space adjusting members abuts on the outer circumferential surface of the photoconductor, and each of the space adjusting members includes, a larger diameter portion, which abuts on the outer circumferential surface of the photoconductor, and at least one smaller diameter portion, which is positioned in the electric resistance adjusting layer side of the larger diameter portion and has an outer diameter smaller than an outer diameter of the larger diameter portion.

2. The conductive member according to claim 1, wherein after the pair of space adjusting members and the electric resistance adjusting layer have been disposed on the conductive supporting body, the outer diameter of the pair of space adjusting members is formed larger than the outer diameter of the electric resistance adjusting layer by conducting an elimination processing on the outer circumferential surfaces of the pair of space adjusting members and the outer circumferential surface of the electric resistance adjusting layer in order to improve an interval accuracy of the space.

3. The conductive member according to claim 1 or claim 2, wherein the pair of space adjusting members comprise insulative parts at least for the end portions adjacent to the electric resistance adjusting layer.

4. The conductive member according to claim 1, wherein the outer circumferential surface of the electric resistance adjusting layer includes a surface layer for preventing adhesion of toner.

5. The conductive member according to claim 4, wherein resistance of the surface layer is larger than resistance in the electric resistance adjusting layer.

6. The conductive member according to claim 1, wherein the electric resistance adjusting layer and the pair of space adjusting members comprise a cylindrical shape including the conductive supporting body as a central axis.

7. The conductive member according to claim 1, wherein the conductive member is used as an electrification member in an image forming apparatus.

8. A process cartridge for an image forming apparatus comprising the conductive member according to claim 1.

9. An image forming apparatus comprising the conductive member according to claim 1.

* * * * *